United States Patent [19]

Garrison et al.

[11] Patent Number: 4,526,137

[45] Date of Patent: Jul. 2, 1985

[54] THERMAL SLEEVE FOR SUPERHEATER NOZZLE TO HEADER CONNECTION

[75] Inventors: Frank E. Garrison, Clinton; George H. Harth, III, Uniontown, both of Ohio

[73] Assignee: The Babcock & Wilcox Company, New Orleans, La.

[21] Appl. No.: 586,528

[22] Filed: Mar. 5, 1984

[51] Int. Cl.[3] ..... F22G 7/14

[52] U.S. Cl. ..... 122/476; 122/360; 122/362

[58] Field of Search ..... 122/466, 477, 476, 360, 122/362; 239/397.5, 591

[56] References Cited

U.S. PATENT DOCUMENTS

| | | | |
|---|---|---|---|
| 911,397 | 2/1909 | Howell | 122/512 X |
| T986,007 | 9/1979 | Papia | 122/360 |
| 2,047,633 | 7/1936 | Jacobus | 122/360 |
| 2,053,413 | 9/1936 | Armacost | 122/476 |
| 2,058,041 | 10/1936 | Shane et al. | 122/476 |
| 4,175,779 | 11/1979 | Apblett | 122/360 X |

*Primary Examiner*—Edward G. Favors

*Attorney, Agent, or Firm*—James C. Simmons; Robert J. Edwards

[57] ABSTRACT

A nozzle to header or pressure vessel connection includes a sleeve preferably of stainless steel extending within the bore of the nozzle and preferably cantilevered therefrom to extend into the aligned flow passage of the header. A portion of the sleeve preferably has an elliptical cross-section which traverses at least part of the distance of the bore and contacts the inner wall of the nozzle for press fitting of the sleeve to the nozzle.

20 Claims, 3 Drawing Figures

THERMAL SLEEVE FOR SUPERHEATER NOZZLE TO HEADER CONNECTION

This invention relates to nozzles for high temperature vessels or headers in industrial, utility, or central station boilers and, more particularly, to an improvement in the connection of high temperature tubes such as boiler superheater tubes to a header.

A header is a chamber which collects or distributes a fluid from or to a number of tubes. Headers are used extensively in modern steam boilers as a means of collecting or distributing steam between two or more boiler circuits. In a type of superheater known as a reheater, for example, spent steam from a turbine is returned through a header to the boiler for reheating in reheater tubes. The reheated steam is similarly returned to the turbine through a collecting or outlet header. Typically, a plurality of tube nipples or tubular nozzles are connected with the wall of the header. Fluid communication is established through flow passages which extend through the wall of the header. Welded tube joints for connection of the nozzles to the header are generally employed in high temperature conditions of the type which occur at the inlets to the header of a reheater or superheater, collectively referred to hereinafter and in the claims as a superheater. In such applications, steam at a temperature in the general range of 1,000 degrees Fahrenheit may typically flow from the tubes to the headers with the temperature of the steam exiting a primary superheater being of course less than the temperature of the steam exiting the corresponding secondary superheater.

Each nozzle is typically inserted into a recess formed in the header wall about the flow passage and secured to the header by a weldment circumscribing the nozzle and partly within the recess. The bore of the nozzle is aligned with the flow passage which extends through the header wall. When such constructions are utilized in high temperature applications such as, for example, superheater tube to header connections, the weldment and the header wall may be thermally stressed by the differences between the temperatures of the header material and the fluid temperature of the steam that passes through the nozzle bore and the connected header flow passage. In particular, hot spots may result from some superheater tube outlet temperatures being greater than the designed temperatue range which hot spots may substantially increase the possibility of cracking in the weldments and header walls. For example, a vessel or header wall may be designed for a temperature of 980° F. to 1030° F. However, the temperature of fluid flowing through some of the nozzles may raise the vessel or header wall temperature at certain hot spots to 1060° F., and the allowable stress, which at 1000° F. is 7.8 psi, may fall off rapidly in this temperature range, for example, at 1050° F. to 5.8 psi and at 1100° F. to 4.2 psi. In addition, oxidation and creep are more prevalent at the higher temperatures. Creep is the tendency of the header to swell and cause stress concentration. During oxidation, oxide wedge cracks are formed. The change in the tendency toward oxidation and creep is much greater per fifty degree temperature difference at this temperature range than at a lower temperature range.

Thermal sleeves have been employed in order to reduce thermal stresses caused by temperature differentials in lower temperature boiler applications such as, for example, economizer to header or attemperator inlet to superheater connections to prevent a cooler fluid from thermally shocking an economizer header or from shocking a superheating tube at the attemperator inlet. The sleeve generally comprises the same material as the nozzle and header and is welded connected. Such arrangements have not been generally utilized or recognized as suitable for high temperature superheater tube to header applications. High thermal conductivity of such a sleeve at such high temperature would dictate that the annulus between such sleeves and the header walls have a relatively large dimension thus necessitating relatively large diameter header flow passages since a sleeve should also have a flow cross-section comparable to that of the original header flow passage. Such a requirement for the header flow passage diameters when such sleeves are used results in the undesirable elimination of substantial header wall material since this would weaken the header wall. Moreover, the higher temperature conditions are conducive to an accelerated oxidation rate which would increase the need for maintenance or replacement of the sleeve. Accordingly, there are disadvantages to the utilization of an attemperator or economizer type sleeve in a superheater nozzle to header connection.

Cracking which has been experienced at the welds and header walls at secondary superheater outlets of operating units has emphasized the need for a solution which could be suitable in the retrofitting of existing superheater tube and header arrangements as well as for use in new installations. Although there are other possible causes for such cracking problems, analysis of the problem has led to the conclusion that such cracking results from the previously discussed hot spots resulting from the greater than design temperatures at the outlets of some superheater tubes. It is an object of this invention to provide a means for insulating the weldments and heater walls at such superheater nozzle to header connections against the effects of such greater than design temperatures at some superheater tube outlets.

The various features of novelty which characterize the invention are pointed out with particularlity in the claims annexed to and forming a part of this specification. For a better understanding of the invention, its operating advantages, and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DETAILED DESCRIPTION OF THE PREFERRED EMBODIMENTS

As used throughout the specification and claims, it should be understood that the term superheater refers to both superheaters and reheaters as are typically employed in industrial, utility and central station boilers.

Figure 1:
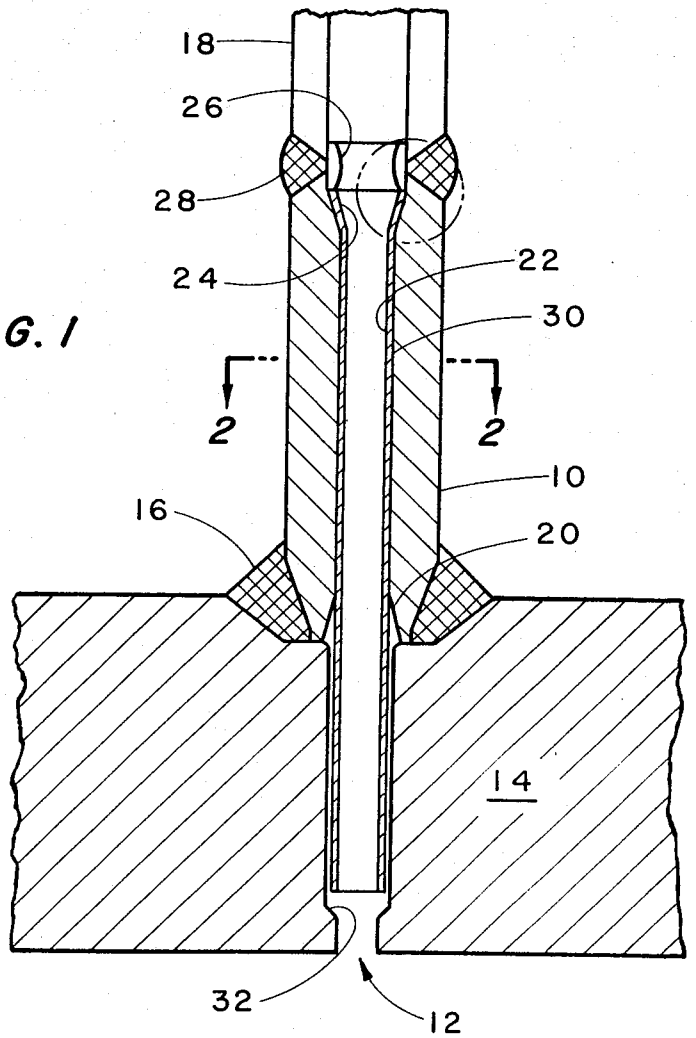
FIG. 1 is a cross-sectional view of an improved nozzle connection to a header (shown in part) in accordance with this invention.

Referring now to FIG. 1, there is shown a nozzle 10 for introducing a fluid into an opening 12 of a wall 14 of a header, only part of which is shown. At one end, the nozzle 10 is rigidly connected to the wall 14 by a weldment 16. The nozzle 10, at its other end, is adapted to be weld connected to a superheater tube 18. The nozzle has a cylindrical bore 20 which extends therethrough and is axially aligned with the opening 12. The bore 20 is preferably conically flared at each of the ends of the nozzle. At the end remote from the header, the bore 20 is conically flared to a diameter corresponding to the inner diameter of the superheater tube 18.

A thermal sleeve 22, which is provided for insulating the header wall and weldment 16 against the temperature of the stream flowing through the nozzle, is press fitted within the bore 20 to dampen undesirable vibration thereof and extends into the opening 12. As used herein, the term "press fitted" refers to a mechanical interference fit which may be achieved with or without a press. The thermal sleeve 22 is radially spaced from the portion of the header wall 14 that surrounds the opening 12 to provide an annulus between the sleeve and header wall. Thus, the thermal sleeve is press fitted in the nozzle 10 to be cantilevered therefrom into the opening 12 so that it may be centered in the opening 12 to prevent the sleeve from contacting the header wall with a resulting loss of insulating effect of the annulus.

At the end near the header, the bore is preferably conically flared to provide an additional thermal barrier to increase the thermal protection of weldment 16 during its normal life and to protect the thermal sleeve 22 from the high temperatures which naturally occur during the welding of the nozzle to the header during installation.

The sleeve 22 is preferably conically flared at its end remote from the header to prevent its displacement axially into the header. The conically flared end 24 is complementary to and seated upon the conically flared portion of the nozzle wall. The sleeve 22 is fixed in place and clamped from axial movement in a direction away from the header by a backing ring 26 which is also employed to back weldment 28 that attaches the nozzle 10 to the superheater tube 18.

Since the sleeve is not welded to the nozzle, a different sleeve material can be used than that of the nozzle. Although it is desirable to remove some of the material along the wall of the header opening 12 during retrofit to remove surface cracks that may have developed during previous use, it is also desirable to minimize the increase in diameter of the opening 12 during retrofit and to minimize the diameter for new installations to prevent undue weakening of the header wall. In accordance with a preferred embodiment of the present invention, a sleeve material, preferably stainless steel, is selected which is generally not corrosive at high superheater temperatures and which has a relatively small heat transfer coefficient to thereby permit the utilization of a smaller annulus between the sleeve and the header wall so that the diameter of opening 12 may be less than what would otherwise be required. For example, a typical header of ferritic steel such as $2\frac{1}{4}$ chrome 1 molybdenum steel and a typical carbon steel nozzle may be provided with a stainless steel sleeve which has a three-quarter inch outer diameter and a 0.065 inch wall. For such a sleeve, the circular header flow passage may have a 13/16 inch diameter, which may have been enlarged by 3/16 inch from a previously existing $\frac{5}{8}$ inch diameter flow passage.

Figure 2:
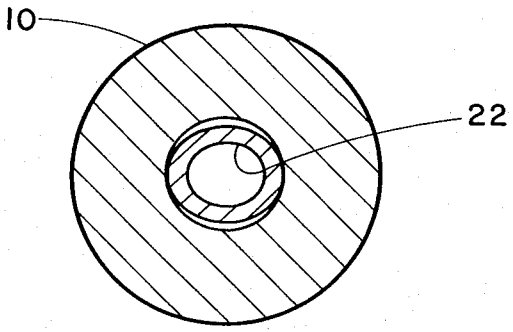
FIG. 2 is a section taken along view line 2—2 of FIG. 1.
Figure 3:
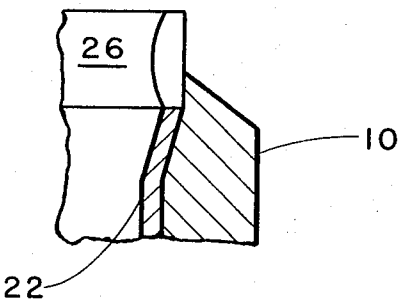
FIG. 3 is an enlarged detail of circled portion of FIG. 1; with the weld omitted.

However, the thermal expansion rate of stainless steel is greater than that of the nozzle material in the example and other suitable sleeve materials may have a thermal expansion rate greater than that of the corresponding nozzle material. If a cylindrical sleeve is press fitted into a nozzle having a cylindrical bore and the sleeve has a greater thermal expansion rate, damage such as cracking may be caused to the nozzle because of the differential thermal expansion rate. In order to prevent such damage from occurring in accordance with a preferred embodiment of the invention, the sleeve 22, over at least part of the length thereof within the nozzle 10, is formed out-of-round preferably with an elliptical cross section. As best shown in FIG. 2, a lengthwise portion 30 has an elliptical cross-section whereby the outer wall of sleeve 22, at opposite ends of the major axis of the elliptical portion, radially engages wall of the nozzle 10 over a distance from near the header at the part where the bore begins to flare radially outwardly to a point intermediate the ends of the nozzle 10. The elliptical section 30 of the sleeve is press fit into the bore 20 against the surrounding nozzle wall to permit its expansion when heated and its return to its original shape when the heat is removed and whereby the spaces between the nozzle wall and sleeve wall provide additional insulating effect. For example, the previously described sleeve having a three-quarter inch outer diameter may be provided for a two inch outer diameter nozzle having a 0.609 inch wall. The sleeve may be provided with an elliptical cross-section over a distance of 3.75 inches for a nozzle length of 7 inches wherein the major axis of the elliptical cross-section is 0.786 inch.

A shoulder 32 is preferably formed in the opening to the header remote from weldment 16 to provide a smaller cross-sectional diameter for restraining the sleeve against displacement into the header chamber. The shoulder 32 is preferably formed at a distance which is axially spaced from the free end of the sleeve 22 to permit axial expansion of the sleeve. In the example provided, the 13/16 inch diameter flow passage may be constricted to a $\frac{5}{8}$ inch diameter at the shoulder, and a $\frac{1}{8}$ inch space axially between the shoulder and sleeve end may be provided for thermal expansion.

The press fitting, without welding, of the sleeve 22 to the nozzle and its extension to the point of attachment of the nozzle to the superheater tube permits its removal by well known means after merely cutting the weldment 28 and removing the backing ring 26 and the superheater tube 18. Without the need to remove the weldment 16 between the nozzle 10 and the wall of the header in order to remove the sleeve, damage which can otherwise attend such removal of weldment 16 may be avoided.

The improved arrangement of the invention is particularly suited for use as a repair for existing tube-to-header connections as well as for new constructions since it may be provided so as not to require significant enlargement of header flow passages. In retrofit situations, the thermal sleeve desirably has a size which generally will fit the dimensions of a flow passage which has been enlarged only sufficiently to remove shallow cracks which may have occurred during previous operations.

It will be recognized by those skilled in the art that the construction of the invention could be similarly applied to other pressure vessel nozzle and wall connections with advantage.

Some features of the present invention can be used to advantage without use of other features of the invention. While specific embodiments of the invention have been shown and described in detail to illustrate the application of the principles of the invention, it is to be understood that the invention may be embodied otherwise without departing from such principles.

The embodiments of the invention in which an exclusive property or privilege is claimed are defined as follows:

1. In a superheater including a header which has a flow passage through a wall thereof and a nozzle which is weldably connected to the header, the nozzle having a bore extending therethrough from a first end to a second end and in fluid communication with the header flow passage at the first end and with a superheater tube at the second end, the improvement comprising a sleeve which extends through at least part of the length of the bore of the nozzle and further extends at least part of the distance through the header flow passage.

2. A superheater as recited in claim 1 wherein the sleeve is formed over at least part of the distance within the bore of the nozzle with a cross-sectional elliptical shape, the sleeve having an outer surface at said elliptical cross-section which is press fitted in the bore of the nozzle.

3. A superheater as recited in claim 2, wherein the sleeve is composed of stainless steel.

4. A superheater as recited in claim 3 wherein the sleeve is cantilevered from the nozzle bore to extend into the header flow passage, and the sleeve has a diameter to define an annular gap between the sleeve and the wall of the header flow passage.

5. A superheater as recited in claim 4 wherein the sleeve extends through the bore to the second end of the nozzle.

6. A superheater are recited in claim 1, further comprising a first conical surface on the inner wall of the second end of the nozzle, the sleeve extends to said second end of the nozzle and has a conical surface on one end thereof which is remote from the header, said sleeve conical surface being received upon said first conical surface, and means for fixing the sleeve against movement in a direction parallel to the axis of the sleeve away from the header.

7. A superheater as recited in claim 6 wherein said fixing means comprises a ring weldably fixed to the nozzle within the bore, said ring abutting against said one end of the sleeve remote from the header.

8. A superheater as recited in claim 6 wherein the sleeve is composed of stainless steel and is formed over at least part of the distance within the bore of the nozzle with a cross-sectional elliptical shape, the sleeve having an outer surface at said elliptical cross-section which is press fitted in the bore of the nozzle, and the sleeve is cantilevered from the nozzle bore to extend into the header flow passage.

9. A superheater as recited in claim 1 wherein the flow passage of the header adjacent the end of the sleeve within the flow passage has a cross-sectional restriction which is spaced from said sleeve end within the flow passage of the header.

10. A superheater as recited in claim 1 wherein the sleeve is cantilevered from the nozzle bore to extend into the header flow passage, and the sleeve has a diameter to define an annular gap between the sleeve and the wall of the header flow passage.

11. A superheater as recited in claim 1 wherein the sleeve is composed of stainless steel.

12. In combination with a nozzle connected to a pressure vessel wall having a flow passage extended therethrough, the nozzle having a bore which extends therethrough from a first end connected to the pressure vessel wall to a second end remote from the pressure vessel wall to establish fluid communication between the bore and the flow passage, a thermal shield comprising a sleeve, means for press fitting the sleeve within said bore of said nozzle, and the sleeve is cantilevered from the nozzle bore into the flow passage to define an annular gap between the sleeve and the wall of the vessel flow passage.

13. In combination with a nozzle connected to a pressure vessel wall having a flow passage extended therethrough, the nozzle having a bore which extends therethrough from a first end connected to the pressure vessel wall to a second end remote from the pressure vessel wall to establish fluid communication between the bore and the flow passage, a thermal shield comprising a sleeve which is composed of a material which has a greater thermal expansion rate than the thermal expansion rate of the material of which the nozzle is composed, and means comprising a portion of the sleeve which has an elliptical cross-section which contacts the nozzle for press fitting the sleeve within said bore of said nozzle.

14. The combination of claim 13 wherein the sleeve is cantilevered from the nozzle bore into the flow passage to define an annular gap between the sleeve and the wall of the vessel flow passage.

15. The combination of claim 14 wherein the sleeve is composed of stainless steel.

16. The combination of claim 15 wherein the sleeve extends through the bore to the second end of the nozzle.

17. The combination of claim 16 further comprising a first conical surface on the inner wall of the second end of the nozzle, the sleeve has a conical surface on one end thereof which is remote from the header, said sleeve conical surface being received upon said first conical surface, and means for fixing the sleeve against movement in a direction parallel to the axis of the sleeve away from the header.

18. The combination of claim 12 wherein the sleeve is composed of stainless steel.

19. In combination with a nozzle connected to a pressure vessel wall having a flow passage extended therethrough, the nozzle having a bore which extends therethrough from a first end connected to the pressure vessel wall to a second end remote from the pressure vessel wall to establish fluid communication between the bore and the flow passage, a thermal shield comprising a sleeve, means for press fitting the sleeve within said bore of said nozzle, a first conical surface on the inner wall of the second end of the nozzle, the sleeve extends to said second end of the nozzle and has a conical surface on one end thereof which is remote from the pressure vessel wall, said sleeve conical surface being received upon said first conical surface, and means for fixing the sleeve against movement in a direction parallel to the axis of the sleeve away from the pressure vessel wall.

20. The combination of claim 13 wherein the sleeve is composed of stainless steel.

* * * * *